US006923034B2

(12) United States Patent
Matsuoka

(10) Patent No.: US 6,923,034 B2
(45) Date of Patent: Aug. 2, 2005

(54) WIRE SPRING FORMING APPARATUS

(76) Inventor: Takeji Matsuoka, 1-44-8, Hikaricho, Kokubunji-shi, Tokyo (JP)

( * ) Notice: Subject to any disclaimer, the term of this patent is extended or adjusted under 35 U.S.C. 154(b) by 161 days.

(21) Appl. No.: 10/376,242

(22) Filed: Mar. 3, 2003

(65) Prior Publication Data

US 2003/0164019 A1 Sep. 4, 2003

(30) Foreign Application Priority Data

Mar. 1, 2002 (JP) ..... 2002-055254

(51) Int. Cl.[7] ..... B21F 23/00
(52) U.S. Cl. ..... 72/137; 226/181
(58) Field of Search ..... 72/64, 65, 78, 72/135, 137; 226/181

(56) References Cited

U.S. PATENT DOCUMENTS

| | | | | |
|---|---|---|---|---|
| 738,933 A | * | 9/1903 | O'Donnell | 72/78 |
| 2,168,340 A | * | 8/1939 | Hill | 72/78 |
| 5,363,681 A | | 11/1994 | Speck et al. | |
| 5,657,657 A | | 8/1997 | Welsh et al. | |
| 6,151,942 A | * | 11/2000 | Itaya | 72/137 |

* cited by examiner

*Primary Examiner*—Lowell A. Larson
(74) *Attorney, Agent, or Firm*—Oblon, Spivak, McClelland, Maier & Neustadt, P.C.

(57) ABSTRACT

A wire spring forming apparatus which can twist a direction of the wire material so as to coincide with a forming direction of the forming tools with a small moment of inertia by positioning a center point of gravity of the pressure feed rollers and a power transmitting means or transmitting a drive force to the pressure feed rollers near the axis of revolution, and has no deflection load in application of pressure to the pressure feed rollers, structured such that one pressure feed roller and a power transmitting means for the pressure feed roller are mounted to a main portion main frame of a revolving means rotatably supported to a main body frame, and another pressure feed roller is mounted to supporting arms swingably attached to a fulcrum shaft rotatably supported to the main frame in perpendicular to a pressure feeding direction of a wire, in the state that gears for driving the pressure feed rollers assembled with the respective pressure feed rollers are engaged together, and the pressure feed rollers are positioned at the substantially middle of a spindle having both ends supported or pivoted to the main frame and the supporting arms, and a point of application of pressure with respect to the pressure feed roller in the side of the supporting arm is positioned immediately above the pressure feed rollers.

9 Claims, 17 Drawing Sheets

WIRE SPRING FORMING APPARATUS

BACKGROUND OF THE INVENTION

1. Field of the Invention

The present invention relates to a wire spring forming apparatus which manufactures a wire spring having various shapes by holding a wire to be formed into the wire spring between pressure feed rollers, pressure feeding the wire on the basis of a rotation of the pressure feed rollers and forcibly applying a process such as a bending process, a curving process or the like to the wire by forming tools radially arranged around an axis of a quill guiding the wire at a position where the wire comes out from the front end of the quill, and more particularly to a wire spring forming apparatus which can twist the wire so that a direction of the wire coincides with a forming direction of the forming tools by a small moment of inertia.

2. Description of the Conventional Art

As the wire spring, there are required structures to which a process such as a bending process, a curving process or the like is applied so as to give various kinds of shapes in correspondence to intended uses thereof. As a result, in conventional, Japanese Unexamined Patent Publication No. 10-29028 discloses a wire spring forming apparatus which manufactures a wire spring having various shapes by mounting forming tools radially arranged around a center line of a quill guiding a wire to be formed into the wire spring on a rotary tooling table so as to turn the forming tools at a desired angle around the center line of the quill, and forcibly applying a process such as a bending process, a curving process or the like from a desired direction by the forming tools turned together with the rotary tooling table at a position where the wire comes out from the front end of the quill.

However, in this wire spring forming apparatus, since it is necessary to turn the rotary tooling table to which a plurality of comparatively heavy forming tools are mounted, around the center line of the quill, a great power source is required. Further, when it is intended to apply the process such as the bending process, the curving process or the like to the wire so as to give the various kinds of shapes as mentioned above, not only the number of the forming tools mounted to the rotary tooling table is necessarily increased, but also a turning angle of the rotary tooling table is increased, so that it is impossible to turn the rotary tooling table for a short time. Accordingly, there is a disadvantage that it is impossible to efficiently manufacture the wire spring.

Accordingly, in order to solve the disadvantage mentioned above, Japanese Patents Nos. 2551525 and 2939472 disclose apparatuses each of which can twist a wire by revolving rotated pressure feed rollers corresponding to a pressure feeding means of the wire around a center line of the wire in the state of holding the wire between the rollers, by a revolving means and can change a position at which the process such as the bending process, the curving process or the like is applied to the wire to a direction in which a desired forming tool is positioned so as to pressure feed to a front end of a quill.

However, both of the apparatuses are structured such that the rotated pressure feed rollers corresponding to the pressure feeding means of the wire are firmly fixed to the front end portions, which protrude to the external of a box-shaped housing, of rotated shafts rotatably supported by bearings which are provided in the front surface and the rear surface within the box-shaped housing, thereby holding the wire between the rollers. Accordingly, the axis of revolution exists outside the box-shaped housing provided therein with a power transmitting means for transmitting a drive force from a drive source to the pressure feed rollers, and the structure is made such that the axis of revolution is biased to one side.

Then, since both of the apparatuses are, as mentioned above, of a type in which the drive source (servo motor) of the rotated pressure feed rollers corresponding to the pressure feeding means of the wire is placed out of the revolving means and is not revolved, the pressure feed rollers rotate (rotate around their own axes) at an angle in proportion to an angle of revolution and the wire is moved in a pressure feeding direction or a reverse direction to the pressure feeding direction when revolving the pressure feed rollers on the basis of a differential phenomenon between a gear assembled so as to be revolved within the revolving means in a transmission gear train corresponding to the power transmitting means for transmitting the drive force to the pressure feed rollers and a gear out of the revolution, so that there is a disadvantage that it is required to do an operation of correcting and setting a value of pressure feed amount of the wire repeatedly while confirming a shape of a product at every time of revolving the pressure feed rollers, for setting up the wire spring forming. In particular, since the wire is frequently pressure fed while the wire is twisted or twisted back by the revolution with being pressure fed by the pressure feed rollers, there is a disadvantage that further much time is required for setting up the forming process.

Further, since both of the apparatuses employ a combination of gears in which the direction of transmission becomes 90 degrees, in addition to a coaxial rotation transmitting mechanism for revolving and pressure feeding the wire, along the axis of revolution, there are disadvantages that a structure of a whole of the apparatus is complex, a blade number of the gears is much, a number of the members is increased, and the apparatus becomes expensive.

Further, as a fateful disadvantage of both of the apparatuses, since the axis of revolution exists out of the box-shaped housing provided therein with the power transmitting means for transmitting the drive force to the pressure feed rollers, a center point of gravity of the box-shaped housing and the power transmitting means provided in the box-shaped housing to transmit the drive force to the pressure feed rollers is far from the axis of revolution and is biased to one side, so that the moment of inertia accompanying with the revolution is significantly great. As a result, since a vibration accompanying with a positioning at a time of the revolution is also increased, a drive source having a large capacity is required for the revolving means, and further it is necessary to keep an acceleration of rotation at a time of positioning at the revolving time to be gentle, so that there is a disadvantage that an efficiency of forming the wire spring becomes very low.

SUMMARY OF THE INVENTION

In order to solve the disadvantages in the conventional arts mentioned above, an object of the present invention is to provide a wire spring forming apparatus which manufactures a wire spring having various shapes by pressure feeding a wire to be formed into the wire spring with pressure feed rollers and forcibly applying a process such as a bending process, a curving process or the like to the wire with forming tools at a position where the wire comes out from the front end of a quill guiding the wire, in which a center point of gravity of the pressure feed rollers and a power transmitting means for transmitting a drive force to the pressure feed rollers are positioned near the axis of revolution, thereby twisting a direction of the wire so as to coincide with a forming direction of the forming tools with a small moment of inertia, and structuring such that a deflection load is not applied in application of pressure to the pressure feed rollers.

THE STEPS TO SOLVE THE PROBLEMS

The inventors of the present invention have found the following matters as a result of research extensive and intensive to solve the problems mentioned above. Accordingly, there is provided a wire spring forming apparatus in which a plurality of forming tools are radially arranged around the axis of a quill guiding a wire, which is held between pressure feed rollers and is pressure fed on the basis of a rotation of the pressure feed rollers, so as to be movable forward and backward in perpendicular to or substantially in perpendicular to the axis of the quill, the pressure feed rollers can revolve around the axis of the wire in the state of holding the wire to be pressure fed between the rollers, wherein one of the pressure feed rollers and a power transmitting means for transmitting a drive force to the pressure feed roller are mounted to a main portion main frame of a revolving means supported to a main body frame rotatably (revolvably) or position adjusting arms in both sides swingably supported to the main portion main frame, and another of the pressure feed rollers is mounted to supporting arms in both sides swingably attached to a fulcrum shaft rotatably supported to the main portion main frame in perpendicular to the wire pressure feeding direction, in the state that gears for driving the pressure feed rollers arranged in contact with the respective pressure feed rollers are engaged with each other, respectively, the pressure feed rollers are positioned at the middle or substantially middle of spindles having both ends supported or pivoted to the main portion main frame or the position adjusting arms and the supporting arms in both sides respectively swingably supported to the main portion main frame, and a point of application of pressure with respect to the pressure feed roller in the side of the supporting arm is positioned immediately above the pressure feed rollers so as to prevent a deflection load. In accordance with the structure mentioned above, the substantial center of the revolving means including the pressure feed rollers which are mounted to the main portion main frame or the position adjusting arms and the supporting arms in both sides respectively swingably supported to the main portion main frame and the power transmitting means for transmitting the drive force to the pressure feed rollers can be coincided with the axis of revolution as much as possible, and the revolving means can be structured such as to be well balanced in vertical and horizontal directions with respect to the axis of revolution and be close to the axis of revolution. Accordingly, it is possible to make the revolving means so as to have a small moment of inertia with respect to the axis of revolution.

Further, in the structure mentioned above, it is possible to employ an aspect in which the pressure feed rollers and the gears for driving the pressure feed rollers which are arranged neighbouring the pressure feed rollers are provided on sleeves which are rotatably attached onto outer peripheral surfaces of spindles having both ends supported to the main portion main frame or the position adjusting arms and the supporting arms in both sides which are respectively swingably supported to the main portion main frame, via inner rings and bearings, an aspect in which the pressure feed rollers and the gears for driving the pressure feed rollers which are arranged neighbouring the pressure feed rollers are provided on sleeves which are rotatably attached onto outer peripheral surfaces of spindles having both ends supported to the main portion main frame or the position adjusting arms and the supporting arms in both sides which are respectively swingably supported to the main portion main frame, via bearings, and an aspect in which the pressure feed rollers and the gears for driving the pressure feed rollers which are arranged in contact with the pressure feed rollers are provided on spindles having both ends pivoted to the main portion main frame or the position adjusting arms and the supporting arms in both sides which are respectively swingably supported to the main portion main frame, via a bearings. Further, when the main portion main frame of the revolving means and the supporting arms are respectively constituted by a U-shaped integrally constructed member supporting or pivoting both ends of a spindle on which the pressure feed roller corresponding to the feeding means for the wire and the gear for driving the pressure feed roller are provided, it is possible to make the center of gravity of the revolving means close to the axis of revolution as much as possible so as to make the moment of inertia of the revolving means as small as possible, whereby it is possible to provide the efficient apparatus in which it is easy to set up the wire spring forming and a production speed is high.

Further, since it is possible to significantly reduce the moment of inertia of the revolving means by employing the structure mentioned above, it is possible to employ a structure in which the drive source of the power transmitting means for transmitting the drive force to the pressure feed rollers is fixed to the main portion main frame and the pressure feed rollers do not rotate (rotate around their own axes) even when revolving the pressure feed rollers in a state that a gear being out of the revolution which is not assembled within the revolving means does not exist in the transmission gear train corresponding to the power transmitting means for transmitting the drive force to the pressure feed rollers. In this case, when the drive source of the power transmitting means for transmitting the drive force to the pressure feed rollers is fixed to the opposite surface of the main portion main frame with gripping a boss portion integrally formed with the main portion main frame of the revolving means so that a through hole for inserting the wire is provided on the axis of an output shaft thereof and the axis of the output shaft coincides with an extension of the axis of the revolving means, it is possible to further reduce the moment of inertia of the revolving means with respect to the axis of the revolving means.

Further, there has been found the matter that in the case that an intermediate linear guide which integrally rotates with a linear guide provided in a front face side of the pressure feed rollers and has a front face side end portion conforming to an axis of a quill is provided in a front face side of the linear guide, it is possible to prevent a forming failure from being generated due to a superposition of a center blurring in the axis of the linear guide provided in the front face side of the pressure feed roller and a center blurring in the axis of the quill in the case of executing a rotational positioning control of the quill around the axis thereof.

DESCRIPTION OF THE PREFERRED EMBODIMENT

Figure 1:
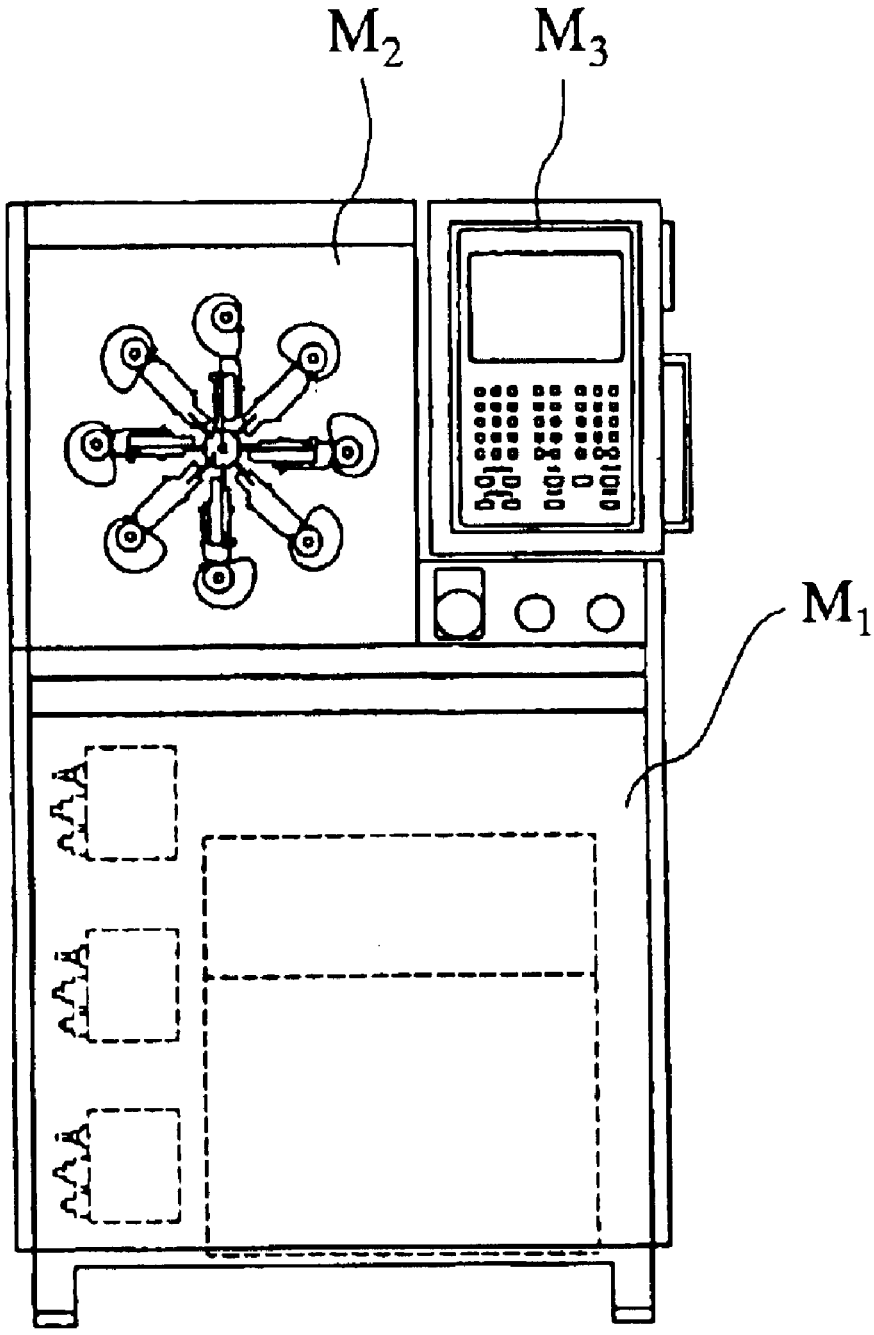
FIG. 1 is a front view of a whole of a first embodiment of a wire spring forming apparatus in accordance with the present invention.
Figure 2:
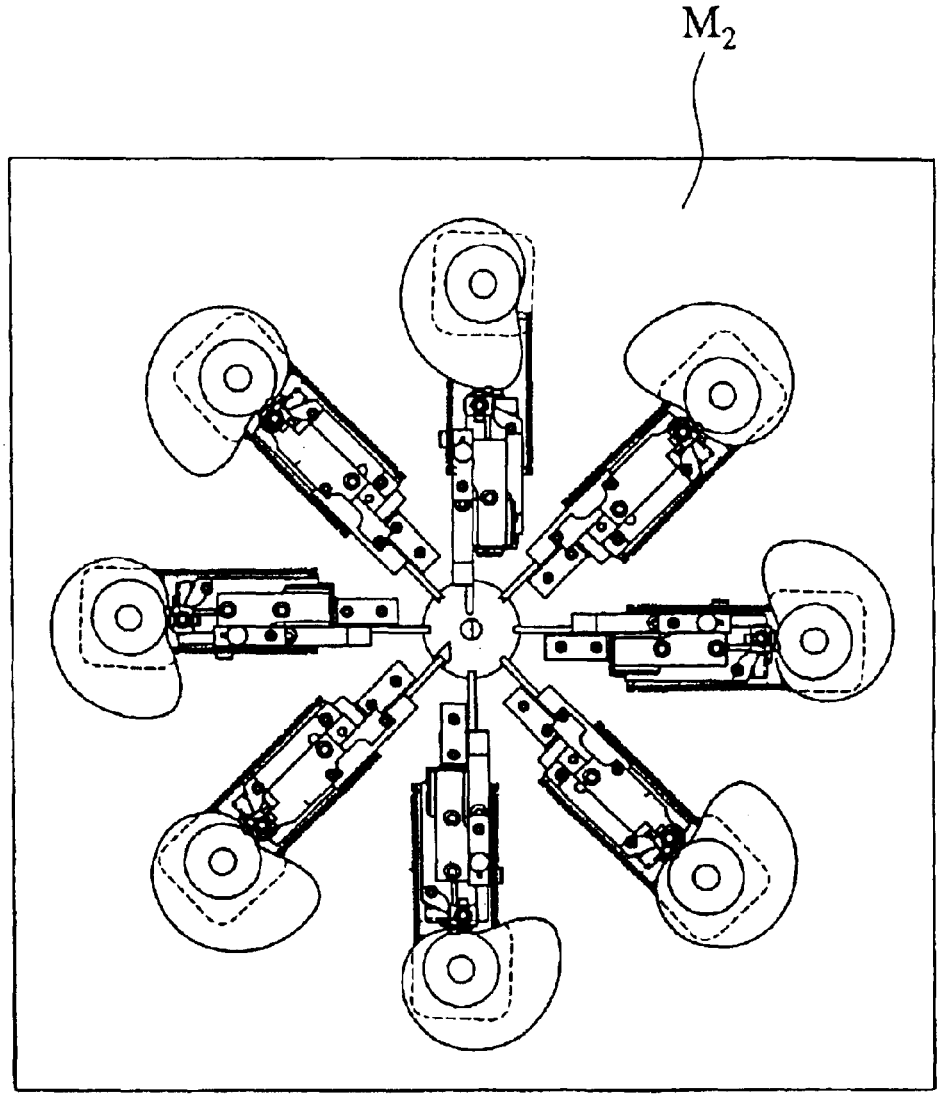
FIG. 2 is an enlarged front view of a wire spring forming stage of an upper base plate in FIG. 1.

A description will be in detail given below of a wire spring forming apparatus in accordance with the present invention with reference to the accompanying drawings:

In the drawings, reference symbol $M_1$ denotes a main body frame supporting, in the upper portion thereof, as shown in FIG. 1, an upper base plate $M_2$ and a multi-axis numerical control apparatus $M_3$ (in an illustrated embodiment, a 10-axis numerical control apparatus since a number of slide units is 8) for positioning servo motors (a servo motor for driving a pair of pressure feed rollers 1 for pressure feeding a wire W to be formed in a wire spring mentioned below, a driving servo motor for revolving a pressure feeding means of the wire W mentioned below, and servo motors for forward and backward moving slide units in which tools are mounted to a wire spring forming stage in a front end portion of a quill mentioned below) corresponding to a drive source. Further, all the servo motors (ten in the illustrated embodiment), a forming stage for forming the wire spring, the pressure feed rollers 1 supported in accordance with a characteristic aspect to a main portion main frame 28 of a simple plate-shaped revolving means rotatably supported to the main body frame $M_1$, and a power transmitting means for transmitting a drive force to the pressure feed rollers 1 are at least mounted to the upper base plate $M_2$.

Figure 3:
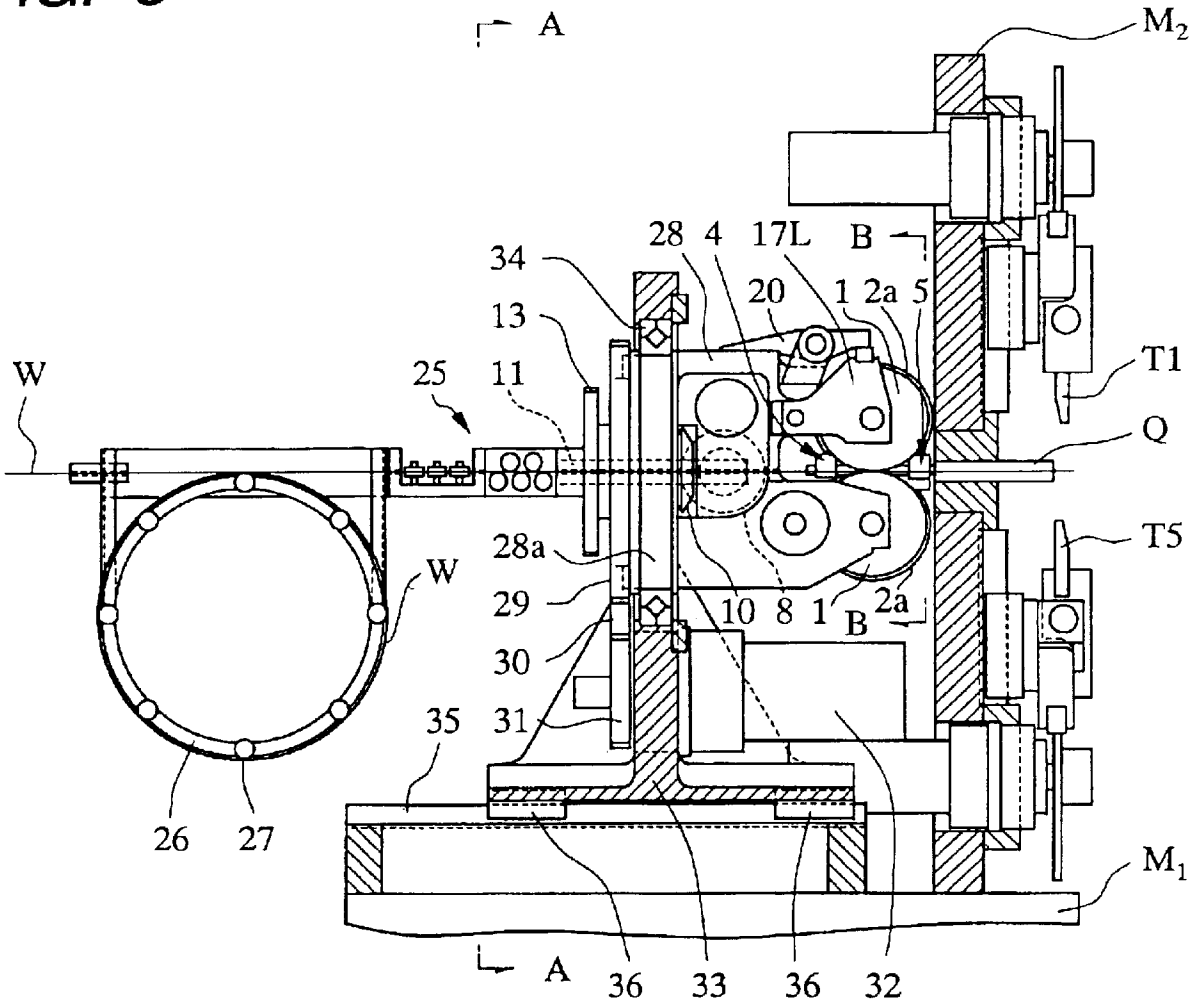
FIG. 3 is a left side schematic view showing a main portion in the center of the wire spring forming stage portion of the upper base plate in FIG. 1 by using a partial cross sectional view.
Figure 4:
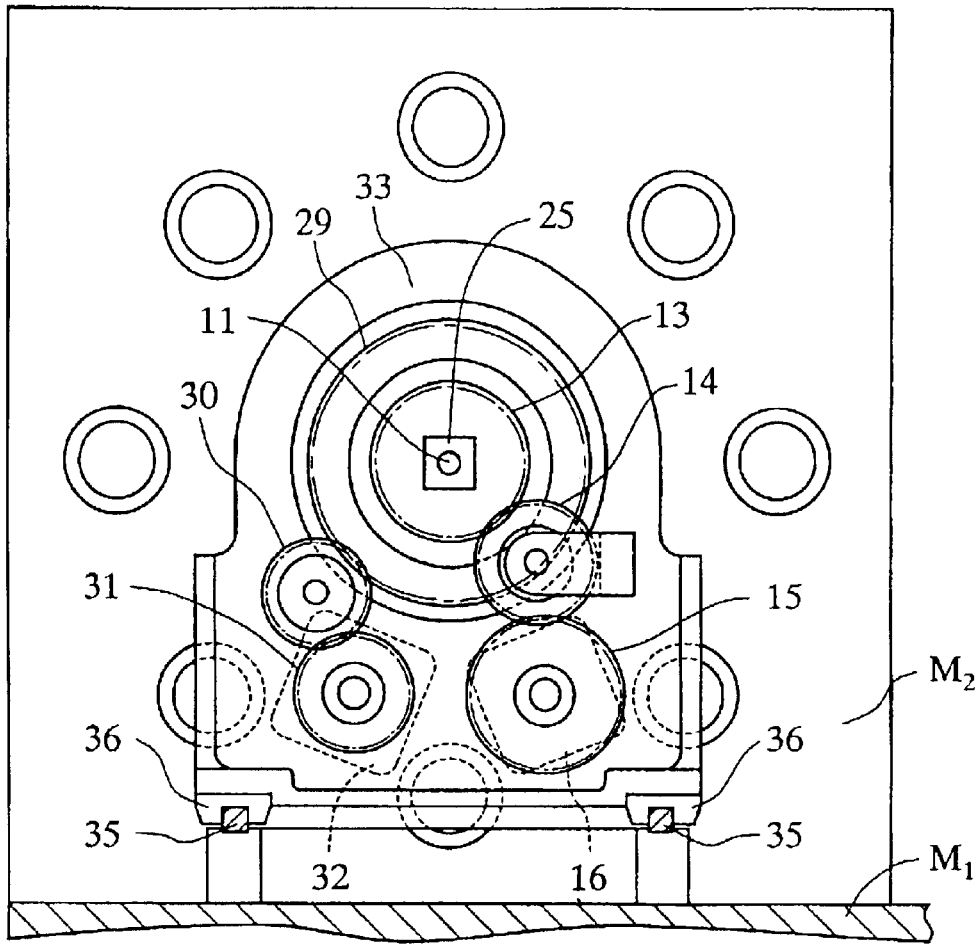
FIG. 4 is a view along a line A—A in FIG. 3.

That is, two rails 35 are provided on the main body frame $M_1$ as shown in FIGS. 3 and 4, a revolving means, a servo motor corresponding to a drive source 32 for the revolving means, and a supporting frame 33 to which a servo motor corresponding to a drive source 16 for a wire pressure feeding means and a part of gear train are attached, are supported to the rails 35 via slide units 36, thereby executing an operation for moving close to a fixed position at the rear end of a quill Q firmly fixed to the front end of the center of the upper base plate $M_2$ or for drawing away to adjust.

Figure 5:
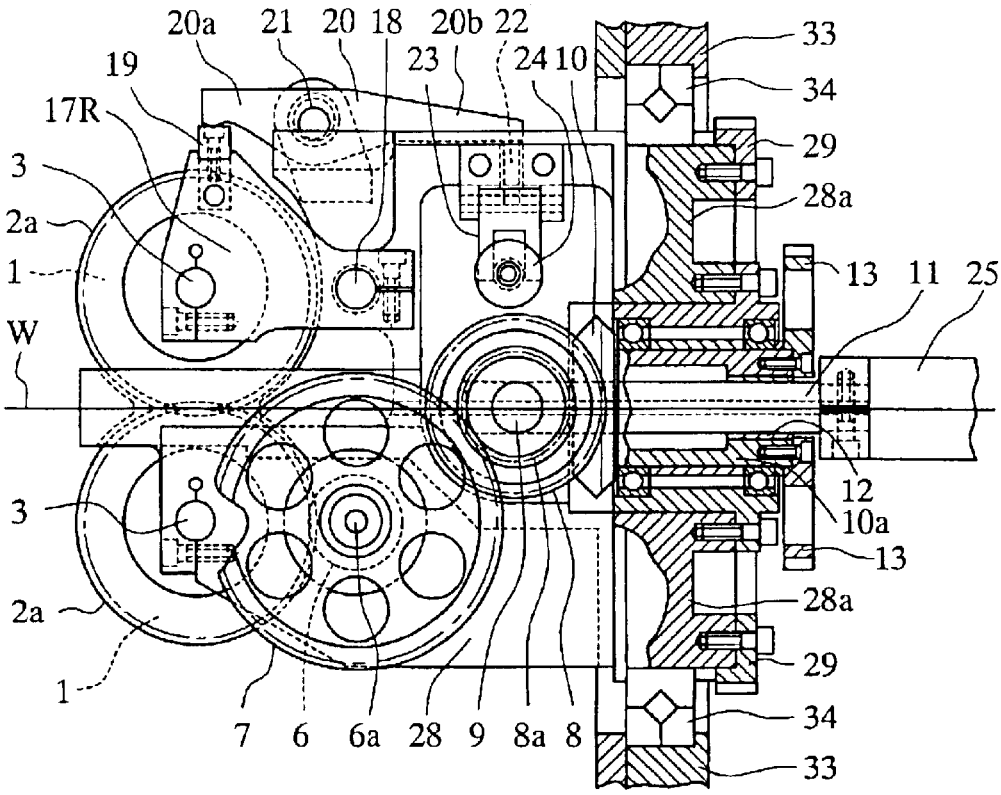
FIG. 5 is a right side schematic view showing a structure of a revolving means in FIG. 3 by using a partial cross sectional view.

Further, as shown in FIGS. 3, 4 and 5, the main portion main frame 28 of the revolving means is rotatably supported to the supporting frame 33 attached to the main frame $M_1$ via a cross roller bearing 34 having a high endurance accuracy, at a position of a disc-shaped boss portion 28*a* integrally formed with the main portion main frame 28, and is driven to rotate (revolve) via a gear train constituted by a pinion 31 fixed to an output shaft of the servo motor corresponding to the drive source 32 for the revolving means mounted to a lower portion of the supporting frame 33, an intermediate gear 30 also mounted to the lower portion of the supporting frame 33 and a revolution drive gear 29 integrally formed with the boss portion 28*a*. Further, a through hole for attaching a hollow shaft 10*a* mentioned below is provided on the center axis of revolution of the main portion main frame 28 and the revolution drive gear 29.

Further, a drive force given by the servo motor corresponding to the drive source 16 for the wire pressure feeding means attached to the supporting frame 33 mentioned above is as shown in FIGS. 4 and 5, transmitted to a bevel gear 10 which is integrally formed in the front end in the quill Q side of the hollow shaft 10*a* and is provided with a through hole capable of inserting a supporting shaft 11 mentioned below, via a gear train constituted by a pinion 15 fixed to an output shaft of the drive source 16 for the wire pressure feeding means, an intermediate gear 14 also attached to the supporting frame 33 and a pressure feed roller drive gear 13 fixed to the hollow shaft 10*a* rotatably supported along the axis of revolution to the main portion main frame 28. Further, a supporting shaft 11 which is protruded to the rear side of the center portion of the boss portion 28*a* integrally formed with the main portion main frame 28 so as to support a wire straigtener 25 for the wire W is fixed to the main portion main frame 28, and a through hole 11*a* capable of inserting the wire W therethrough is provided at the axis of the supporting shaft 11. In this case, reference numeral 12 denotes an auxiliary oilless metal for the supporting shaft 11.

The wire straigtener 25 for the wire W and a orientation looper 26 for the wire W which is connected to the wire straigtener 25 are supported by the supporting shaft 11 fixed to the main portion main frame 28, as shown in FIG. 3, and both of the wire straigtener 25 and the orientation looper 26 revolve in correspondence to the revolution of the main portion main frame 28. Accordingly, the wire W is guided by a guide rollers 27 (eight sets in the illustrated embodiment) provided in the orientation looper 26, passes through a through hole 11*a* provided on the axis of the supporting shaft 11, and is guided by linear guides 4 and 5 provided in the front side and the back side of the pressure feed rollers 1 so as to be fed out to the forming stage at the front end of the quill Q by the pressure feed rollers 1. In this case, a swing accompanying with the revolution of the axis of the linear guide 5 supported to the main portion main frame 28 with respect to the axis of the quill Q is significantly small because the cross roller bearing 34 is used as a means for rotatably supporting the main portion main frame 28.

Figure 6:
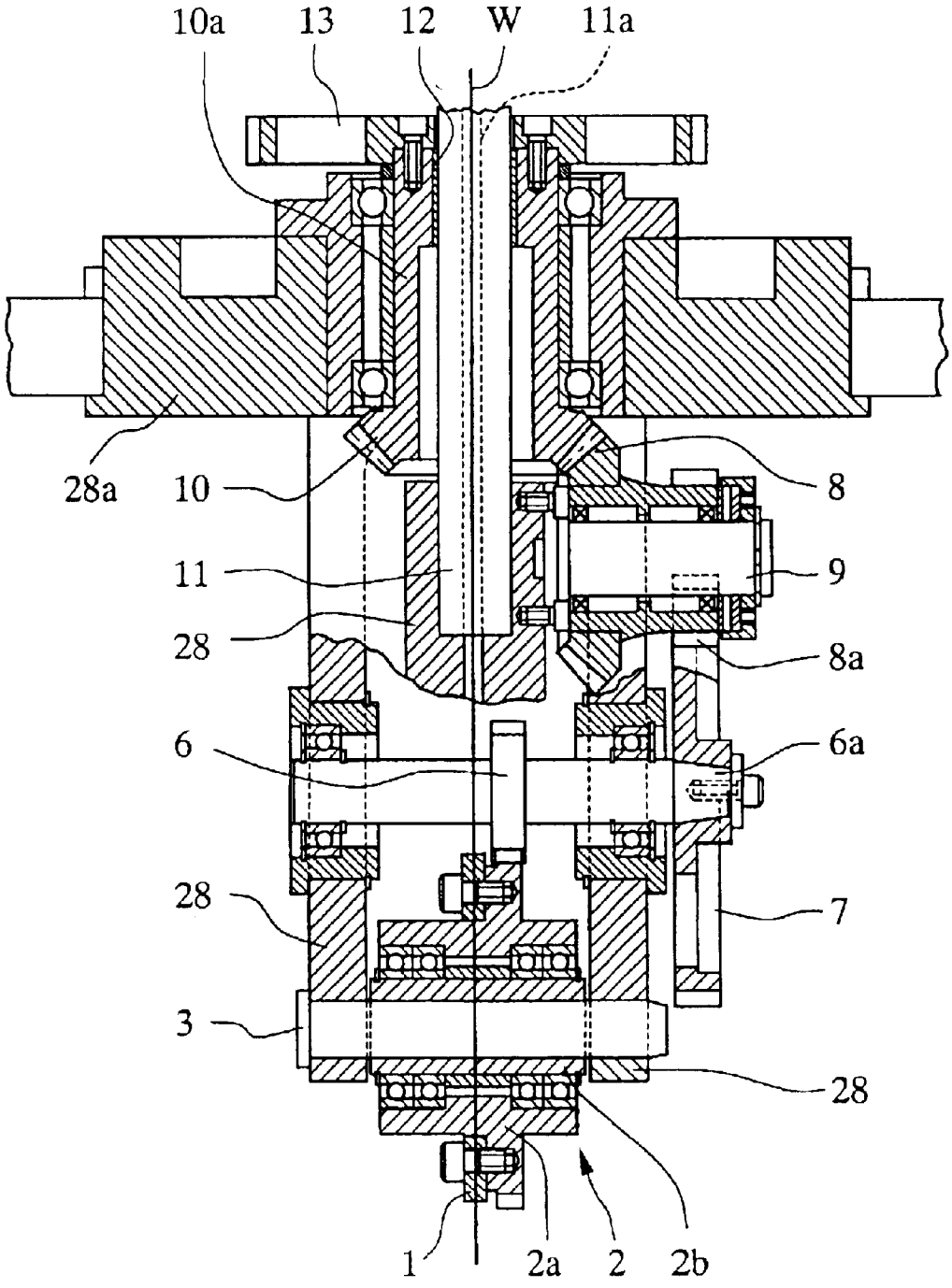
FIG. 6 is a plan cross sectional schematic view showing the structure of the revolving means in FIG. 3.
Figure 7:
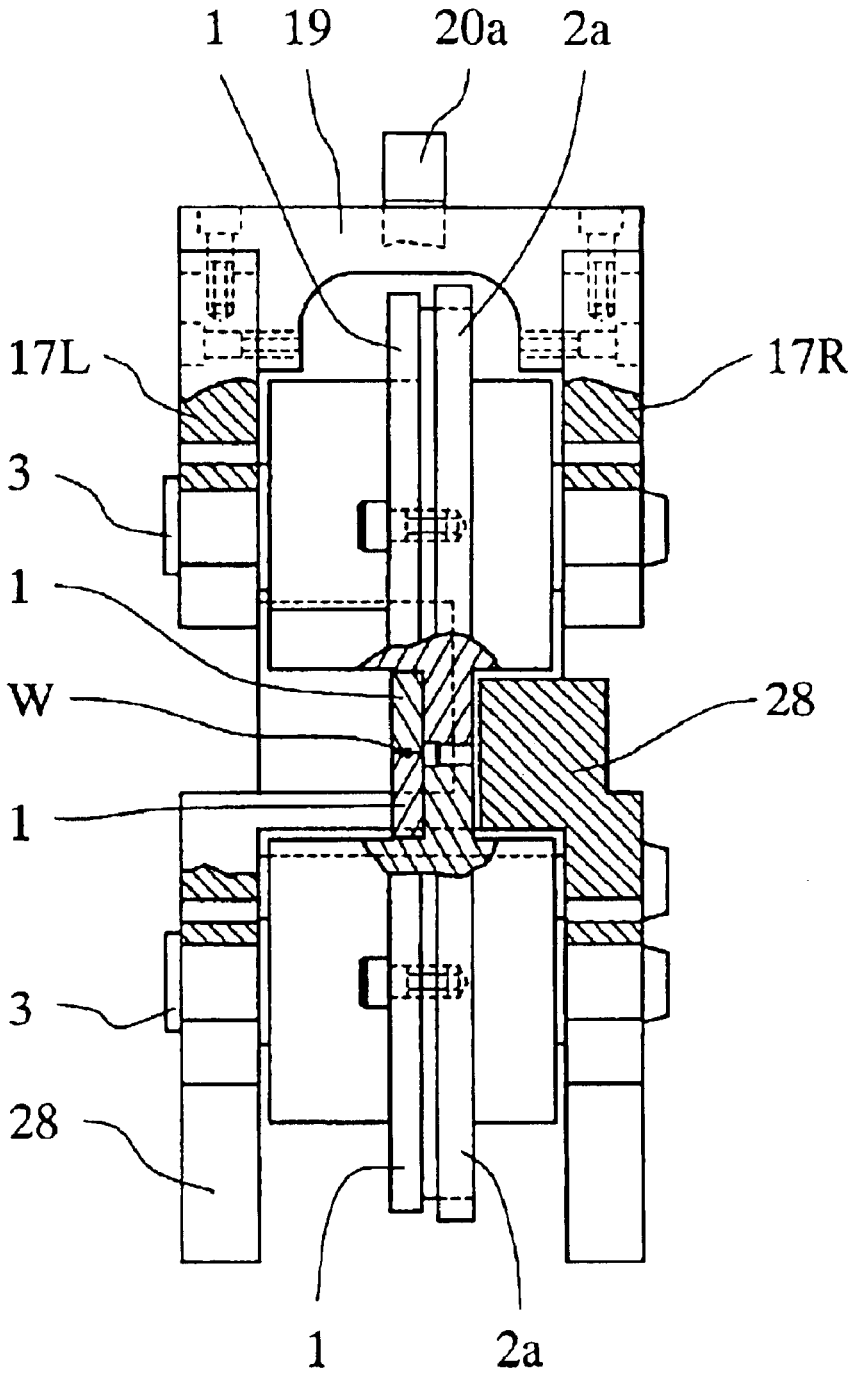
FIG. 7 is an enlarged schematic view showing a part in a line B—B in FIG. 3 by using a cross sectional view.

The drive unit 2 for rotating the pressure feed rollers 1 for the wire corresponding to the main portion of the pressure feeding means for the wire W is based on an aspect in which the pressure feed roller 1 and a gear 2*a* for driving the pressure feed roller which is arranged neighbouring the pressure feed roller 1 are fixed to a sleeve rotatably attached onto an outer peripheral surface of a spindle 3 having both ends supported to both sides supporting arms 17L and 17R swingably attached to a fulcrum shaft 18 rotatably supported to the main portion main frame 28 in perpendicular to the main portion main frame 28 and the pressure feeding direction of the wire W, via an inner ring 2*b* and a bearing. That is, the structure is made in a cartridge type in which the sleeve in which the gear 2*a* is provided on the outer surface thereof as shown in FIG. 6 is rotatably supported to the inner ring 2*b* via a plurality of bearings, whereby it is possible to attach and detach the pressure feed roller 1 with respect to the side surface formed in a flange shape in the gear 2*a*, and the spindle 3 can be precisely inserted into and pulled out from the through hole within the inner ring 2*b*, so that the spindle 3 is fitted into or out from holes provided in the main portion main frame 28 and the supporting arms 17L and 17R so as to be attached and detached. In the manner mentioned above, at a time when the pressure feed rollers 1 are respectively mounted to the main portion main frame 28 and the supporting arms 17L and 17R by the spindles 3, the pressure feed rollers 1 are positioned in the middle or substantially in the middle of the spindle 3, that is, in the middle or substantially in the middle between the portions supporting the both ends of the spindle 3 the main portion main frame 28 and of the supporting arms 17L and 17R, and the gears 2*a* in a pair of drive units 2 are engaged with each other in a state in which the pressure feed rollers 1 hold the wire W between them. In this case, when the main portion main frame 28 and the supporting arms 17L and 17R are respectively formed into a U-shaped integrally constructed member, it is possible to make the center of gravity of the revolving means close to the axis of revolution as much as possible so as to make the moment of inertia of the revolving means as small as possible.

Figure 17:
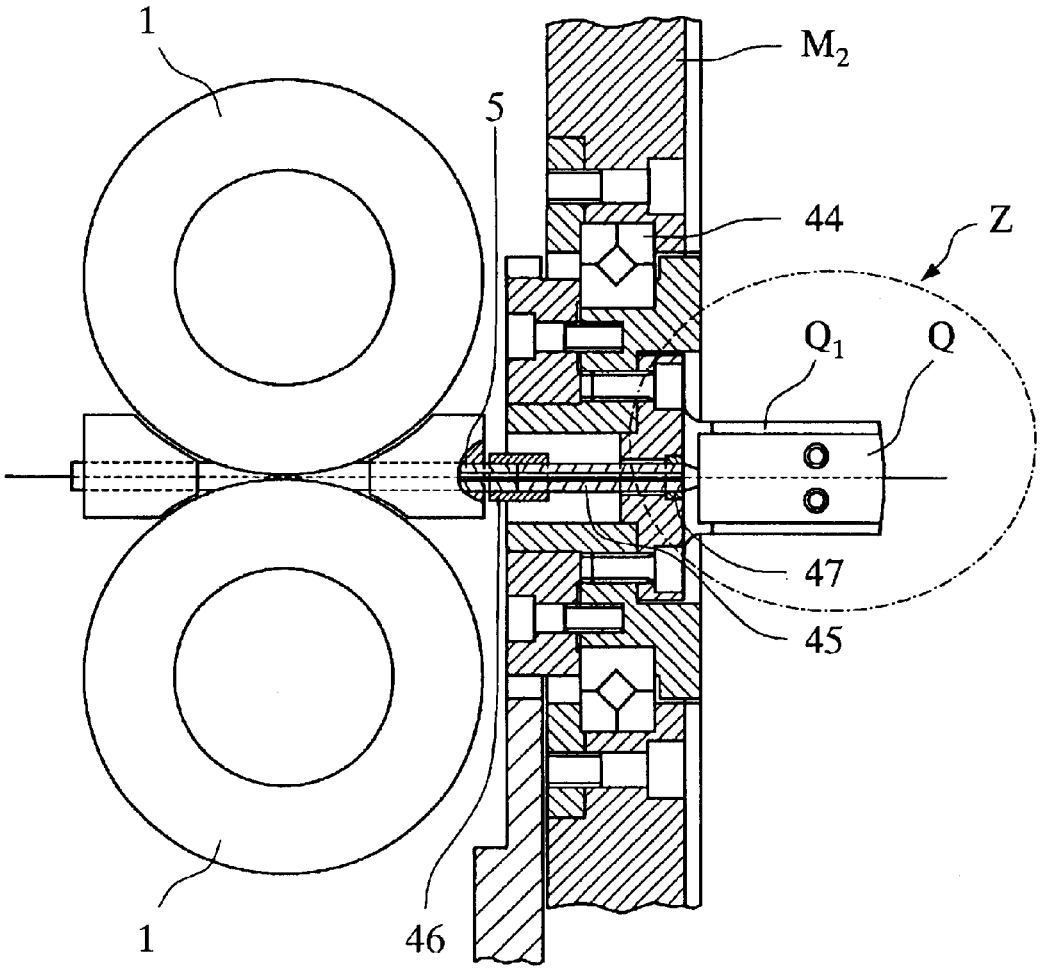
FIG. 17 is a cross sectional schematic view of a main portion of an other embodiment of the wire spring forming apparatus in accordance with the present invention, in which the quill is structured such as to be rotationally positioned and controlled around an axis thereof, and an intermediate linear guide integrally rotating with a linear guide provided in a front face side of the pressure feed roller and having a front face side end portion conforming to an axis of the quill is provided in a front face side of the linear guide.
Figure 18:
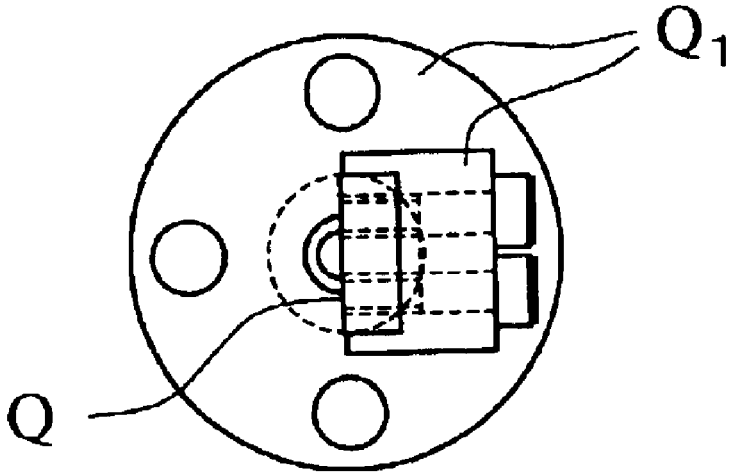
FIG. 18 is a right side elevational view of a portion Z in FIG. 17.

Further, in recent years, the wire spring forming apparatus generally has a function of executing a rotational positioning control of the quill around an axis of the quill, however, in the case of providing with the function of executing the rotational positioning control of the quill around the axis thereof, micro center blurrings comprising a center blurring of the axis of the quill caused by the rotation and a center burring of the axis of the linear guide provided in the front face side of the pressure feed roller are superposed, whereby the linear guide and the quill are deteriorated in passing the wire therethrough in the case that the wire is narrow, so that a directivity of the wire fed out to a forming stage at a front end of the quill becomes unstable and it is hard to secure an accuracy in a product. In this case, as shown in FIGS. 17 and 18, when an intermediate linear guide 45 which is rotated integrally with a linear guide 5 provided in a front face side of the pressure feed rollers 1 and has a front face side end portion conforming to an axis of a quill Q is provided in a front face side of the linear guide 5, the wire W fed out from a portion on the axis of the linear guide 5 moves along the axis of the intermediate linear guide 45 and is fed out in a state of conforming to the axis of the quill Q, so that an accuracy of the product can be secured. That is, in these FIGS. 17 and 18, a quill holder $Q_1$ which supports the quill Q is rotatably supported to an upper base plate $M_2$ by a cross roller bearing 44, and the intermediate linear guide 45 is rotatably supported to the front face side of the rotatable quill holder $Q_1$ by a bearing 47 provided close to the quill Q. Further, in this FIG. 17, since the intermediate linear guide 45 is constructed by a cemented carbide steel which can be assumed to be a rigid body after a manner, the intermediate linear guide 45 is connected to the linear guide 5 by a joint 46 formed by a soft resin sleeve so that the axes of the both elements are made conformed at the connection portion and the intermediate linear guide 45 can be integrally rotated with the linear guide 5. However, there is no need that the joint 46 mentioned above has a flexibility in the case that the intermediate linear guide 45 employs a material having the same hardness as that of the cemented carbide steel and having the flexibility such as an ultra-fine particle tungsten carbide which was developed in these years by TOSHIBA TUNGALOY CO., LTD (name of article: Tungaloy EM-10).

Figure 8:
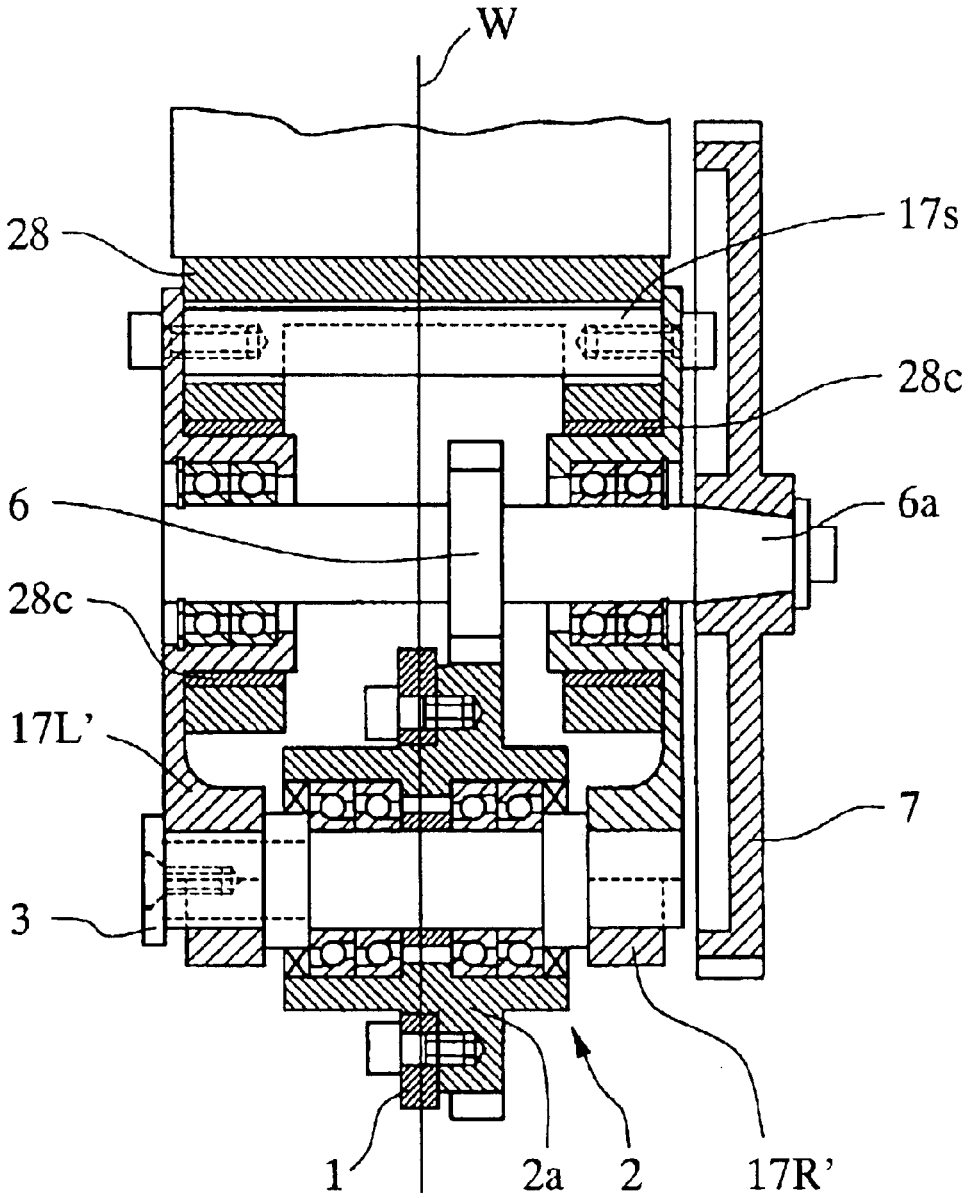
FIG. 8 is a plan cross sectional schematic view showing a part corresponding to a lower side portion in FIG. 6 in the case that an other embodiment of the pressure feed rollers and a spindle to which gears for driving the pressure feed rollers are mounted in adjacent to the pressure feed rollers are respectively supported by position adjusting arms.
Figure 9:
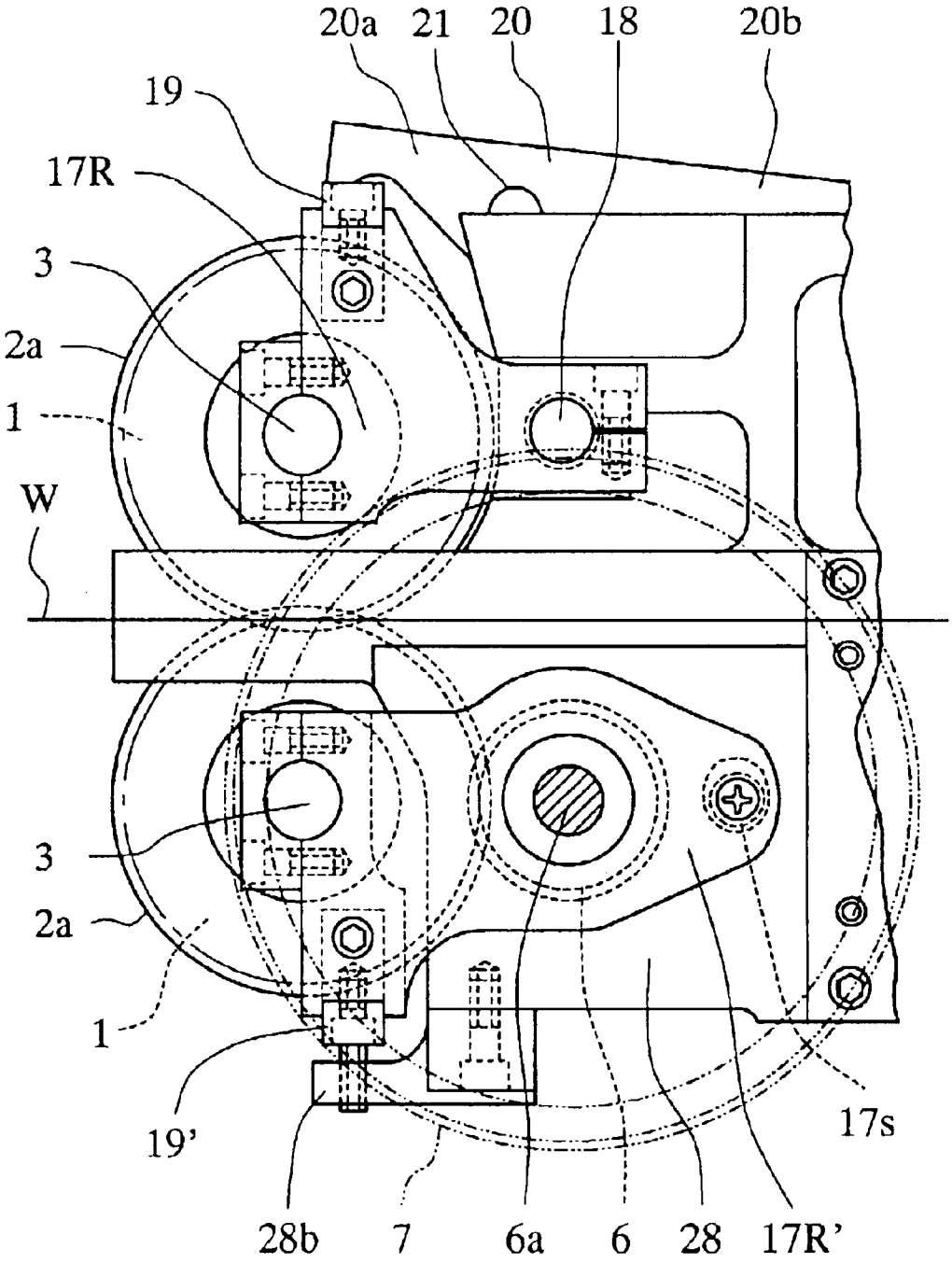
FIG. 9 is a right side schematic view of FIG. 8.

Further, in the case that the wire W to be pressure fed is thin and the diameter of the pressure feed rollers 1 is made small in correspondence thereto, whereby the apparatus of the present invention is made compact as shown in FIGS. 8 and 9, the structure can be made in a cartridge type that the sleeves in which the gears 2*a* are provided on the outer surface without using the inner rings 2*b* are directly rotatably attached to the spindles 3 via a plurality of bearings in the aspect shown in FIG. 6. In this case, in order to mount the spindles 3 to which the pressure feed rollers 1 and the gears 2*a* are rotatably attached to each of the main portion main frame 28 and the supporting arms 17L and 17R, the structure is made such as to split spindle supporting portions at both ends of both side position adjusting arms 17L' and 17R' swingably attached to the main portion main frame 28 around the center line of the oilless metals 28*c* by fitting boss portions of the position adjusting arms 17L' wire 17R' to respective portions within the oilless metals 28*c* arranged within the holes provided in perpendicular to the pressure feeding direction of the wire W in both frames of the main portion main frame 28 constituted by the U-shaped integrally constructed member, and both sides supporting arms 17L and 17R attached to the fulcrum shaft 18 rotatably supported to the main portion main frame 28 also in perpendicular to the pressure feeding direction of the wire W, into two sections so as to assemble by bolts or the like for supporting the spindles 3. In this case, a rotary shaft 6*a* in which an intermediate pinion 6 for driving the pressure feed rollers 1 mentioned below is rotatably supported within the boss portion of the position adjusting arms 17L' and 17R' respectively fitted within the oilless metals 28*c* mentioned above.

Further, although an illustration is omitted, the drive unit 2 for rotating the pressure feed rollers 1 constituting the main portion of the pressure feeding means for the wire W may employ an aspect that the pressure feed rollers 1 and the gears 2*a* for driving the pressure feed rollers arranged neighbouring the pressure feed rollers 1 are fixed to the spindles 3 which are pivoted to the main portion main frame 28 or the position adjusting arms 17L' and 17R' and the supporting arms 17L and 17R in both sides respectively swingably supported to the main portion main frame 28 at both ends via the bearings. In this case, in order to mount in such a manner as to respectively pivot the spindles 3 assembled with the pressure feed rollers 1 and the gears 2*a* to the main portion main frame 28 or the position adjusting arms 17L' and 17R' and the supporting arms 17L and 17R in both sides respectively swingably supported to the main portion main frame 28, the structure is made such as to split the main portion main frame 28 or the supporting portions supporting the outer rings of the bearings attached to both ends of the position adjusting arms 17L' and 17R' in which the boss portions are respectively fitted into the oilless metals 28*c* arranged within the holes provided in perpendicular to the pressure feeding direction of the wire W in the main portion main frame 28 similarly to the aspect shown in FIG. 9, and the supporting arms 17L and 17R in both sides attached to the fulcrum shaft 18 rotatably supported to the main portion main frame 28 also in perpendicular to the pressure feeding direction of the wire W, whereby it is possible to assemble by bolts or the like for supporting the outer ring of the bearing.

Further, upper ends portions of the supporting arms 17L and 17R are connected by a bridge 19, and the structure is made such that a pressure of the pressurizing lever 20 for gripping the wire W by the pressure feed rollers 1 is applied to the bridge 19.

Further, in the case of the position adjusting arms 17L' and 17R' in both sides, the structure is made in the same manner such that lower end portions thereof can resist the pressure of the pressurizing lever 20 by a bridge type stopper 28*b* adhered to the front end portion of the main portion main frame 28 via a bridge 19' so as to maintain the pressure feed rollers 1 at a predetermined position, and rigidity of the U-shaped structure due to the connection of the bridge 19' is enhanced by connecting and fixing the position adjusting arms 17L' and 17R' to each other by a stay 17*s*.

A description will be given in more detail. Since a front end portion 20*a* of the pressurizing lever 20 supported by an eccentric shaft 21 provided in the upper portion of the main portion main frame 28 in FIG. 5 is positioned in the middle or the substantially middle of the bridge 19, that is, immediately above the pressure feed rollers 1 attached to the drive unit 2 mentioned above, and the structure is made such that a rear end portion 20*b* of the pressurizing lever 20 is pushed up via a lever 23 and a pin 22 due to a pressure of a pressure adjusting mechanism 24 provided in the main portion main frame 28 the pressure feed rollers 1 supported by the supporting arms 17L and 17R are pressed via the bridge 19 and thus the wire W can be pressure fed in a state that no deflection load is applied to the pressure feed rollers 1.

Further, in the case of a bridge type stopper 28*b* supporting the bridge 19' connected and fixed to the position adjusting arms 17L' and 17R', it is positioned immediately below the pressure feed rollers 1, and the pressurizing force to the pressure feed rollers 1 is applied in the state with no deflection load.

Further, in FIG. 5, the structure is made such that the bevel gear 10 is exposed to a rotational torque of the servo motor corresponding to the drive source 16 for the wire pressure feeding means attached to the supporting frame 33 via the gear train so as to rotate and the rotational torque is transmitted to a pinion 8*a* integrally structured with the bevel gear 8 from the bevel gear 8 pivoted to the supporting shaft 9 fixed to the main portion main frame 28, and is transmitted to the intermediate pinion 6 integrated with the rotary shaft 6*a* via the intermediate gear 7 fixed to the rotary shaft 6*a* pivoted to the main portion main frame 28, thereby rotating the gear 2*a* for the pressure feed rollers arranged neighbouring the pressure feed rollers 1 of the drive unit 2 and engaged with the intermediate pinion 6.

Figure 11:
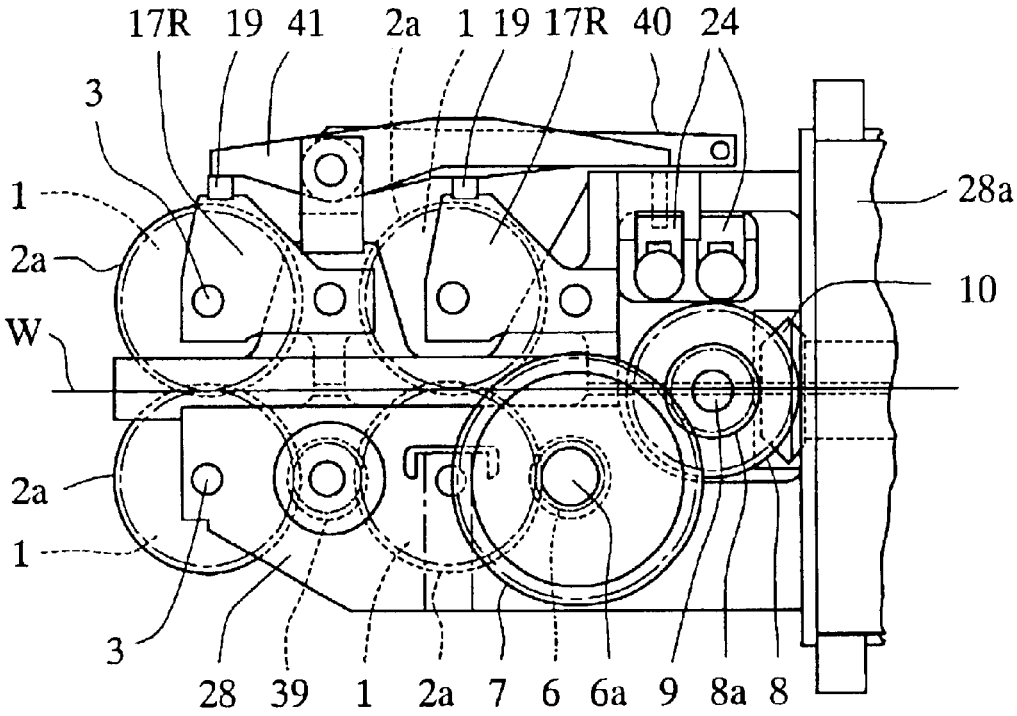
FIG. 11 is a right side schematic view of a revolving means portion in an other embodiment of the wire spring forming apparatus in accordance with the present invention in which four pressure feed rollers are provided.

Here, in the case that two pairs of pressure feed rollers 1 are provided as shown in FIG. 11, the structure is the same as the embodiment mentioned above except a point that a second intermediate pinion 39 for interlock is interposed between lower two drive units 2. Reference numeral 40 denotes a pressurizing lever for the pressure feed rollers 1 in the rear portion, and reference numeral 41 denotes a pressurizing lever for the pressure feed rollers 1 in the front portion.

Next, a description will be given of a case of revolving the pressure feeding means for the wire W and the servo motor corresponding to a drive source 37 for the pressure feeding means together.

Figure 10:
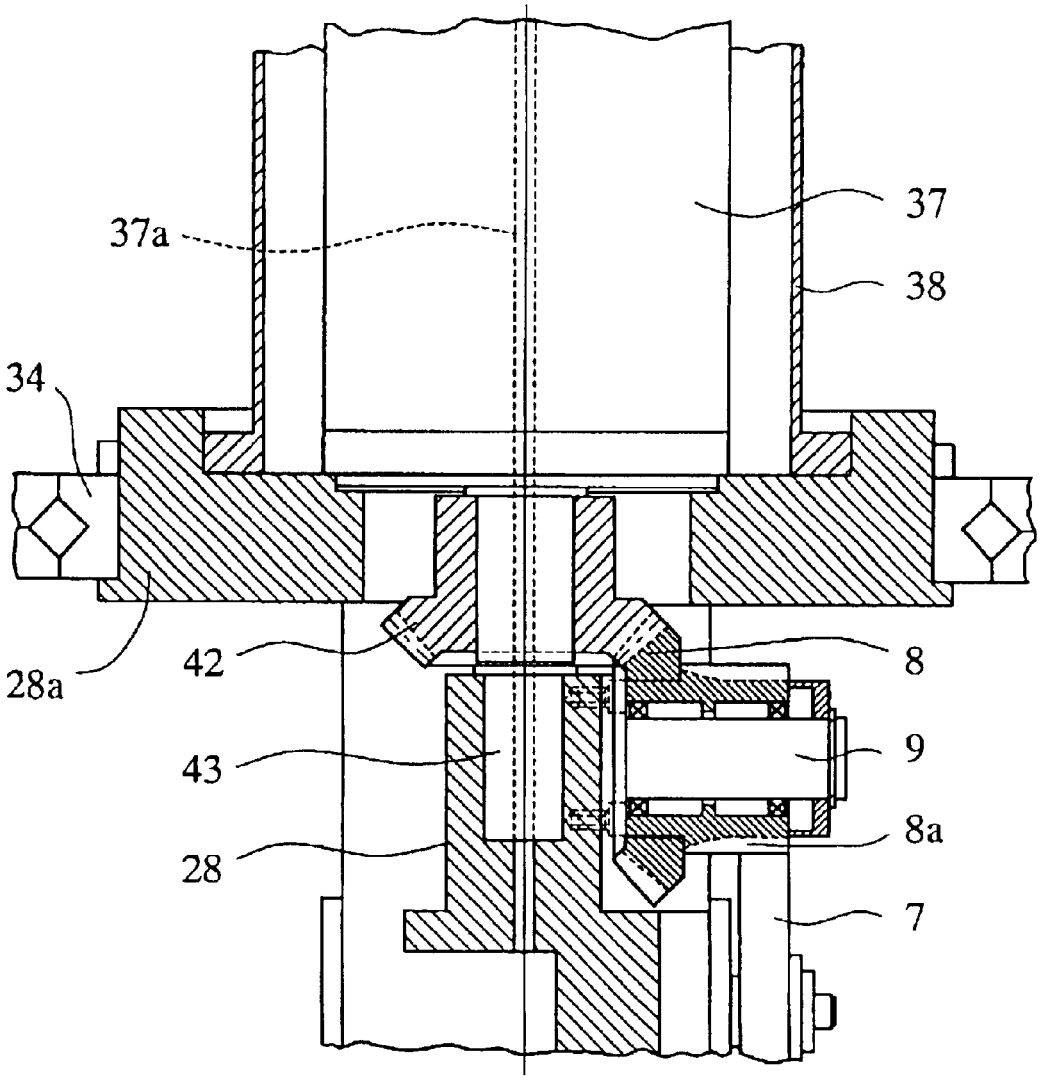
FIG. 10 is a cross sectional schematic view of a main portion of an other embodiment of the wire spring forming apparatus in accordance with the present invention in which the drive source of the pressure feed means is placed inside the revolving means.

In FIG. 10, the drive source 37 for the pressure feeding means is attached to the rear surface of the boss portion 28*a* of the main portion main frame 28 so that the axis of a through hole 37*a* provided along the axis of an output shaft of the drive source 37 coincides with an extended line of the through hole provided along the axis of revolution of the main portion main frame 28, a bevel gear 42 fixed to the output shaft of the drive source 37 so as to make the wire W pass through is engaged with the bevel gear 8, and the pressure feed rollers 1 are rotated via the drive gear train from the bevel gear 8 to the drive unit 2 mentioned above. Further, reference numeral 43 denotes a wire guide piece which is inserted and screwed into the main portion main frame 28 in place of the supporting shaft 11 of the wire straigtener 25. Further, the wire straigtener 25 and the orientation looper 26 are supported by a supporting tube 38 fixed to the boss portion 28*a* of the main portion main frame 28 in such a manner as to surround the drive source 37 of the pressure feeding means, and holes (not shown) are provided in some portions of the supporting tube 38 so as to prevent the drive source from being heated.

Figure 12:
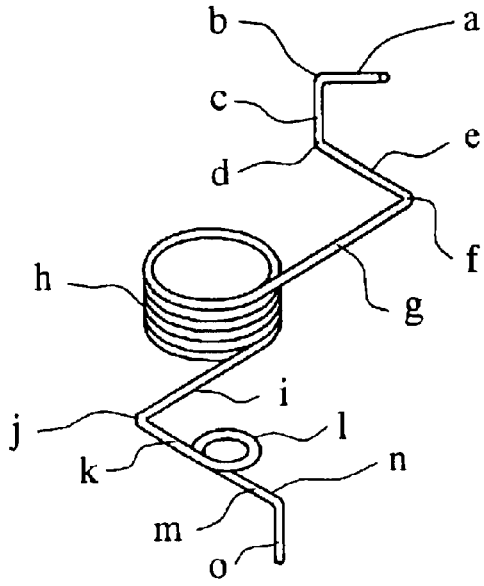
FIG. 12 is a schematic view showing one example of the wire spring formed by the wire spring forming apparatus in accordance with the present invention.
Figure 14:
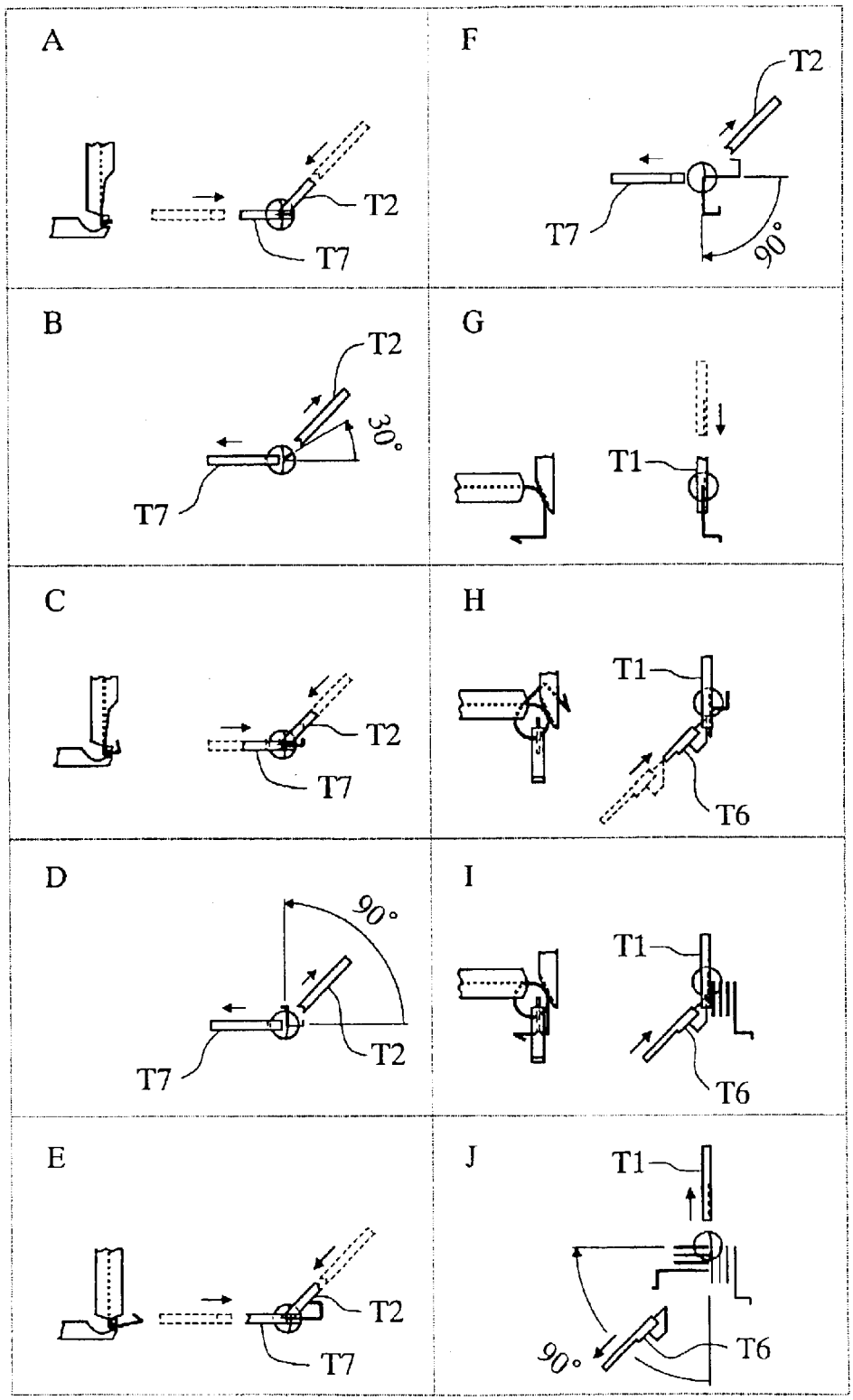
FIG. 14 is a view of a forming process of the wire spring shown in FIG. 12.
Figure 15:
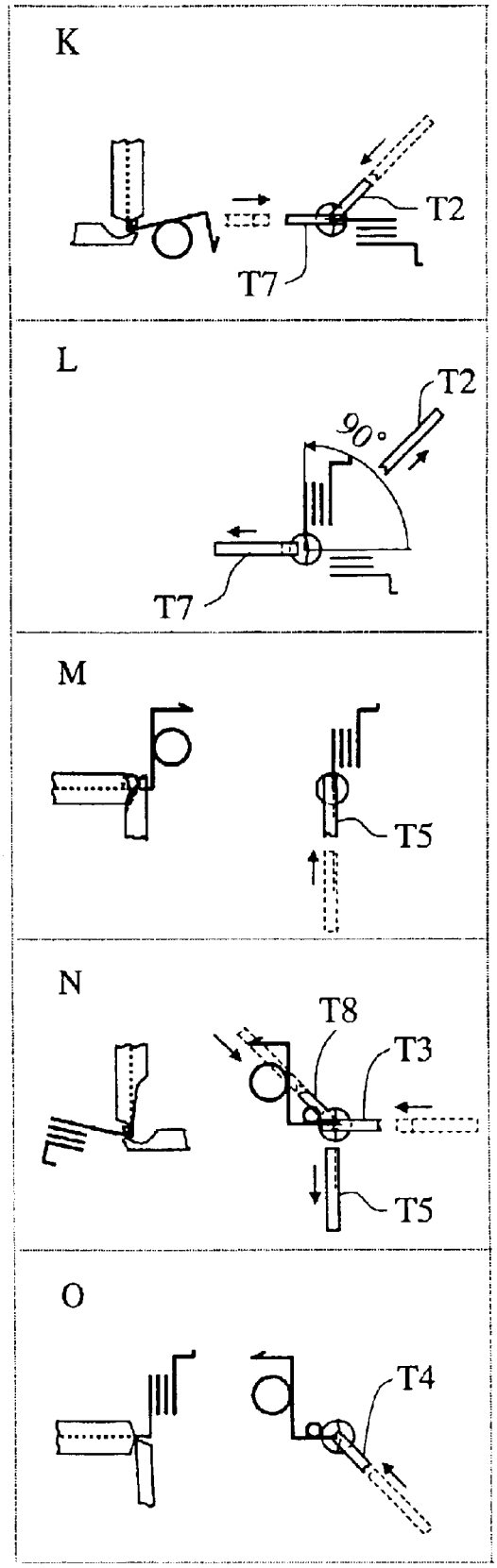
FIG. 15 is a view of the forming process of the wire spring following to the process in FIG. 14.
Figure 16:
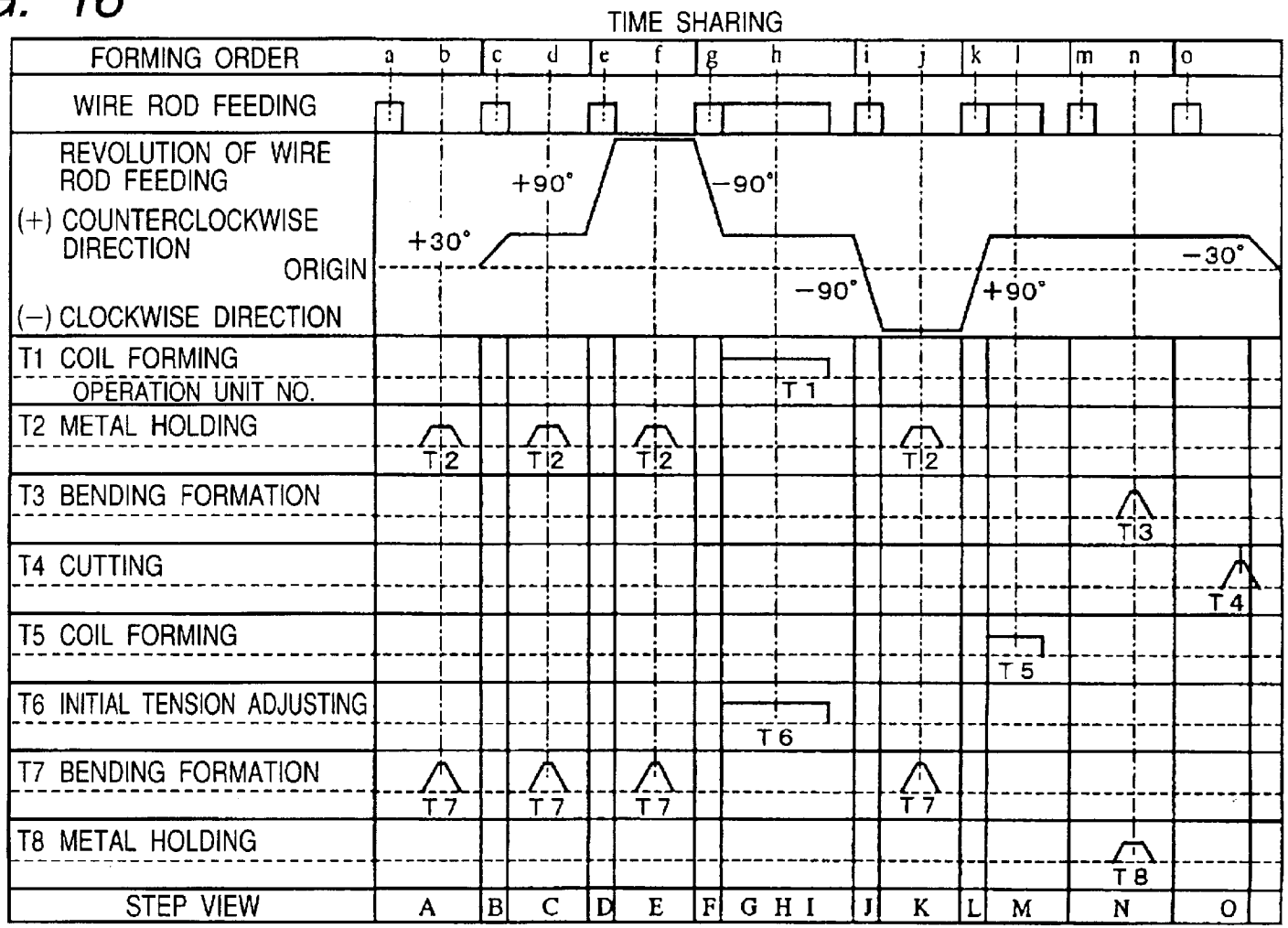
FIG. 16 is a diagram o time sharing to form the wire spring shown in FIG. 12.

Next, a description will be given of an operation of forming a wire spring shown in FIG. 12 by using the wire spring forming apparatus in accordance with the present invention having the structure mentioned above, on the basis of wire spring forming process views shown in FIGS. 14 and 15.

Figure 13:
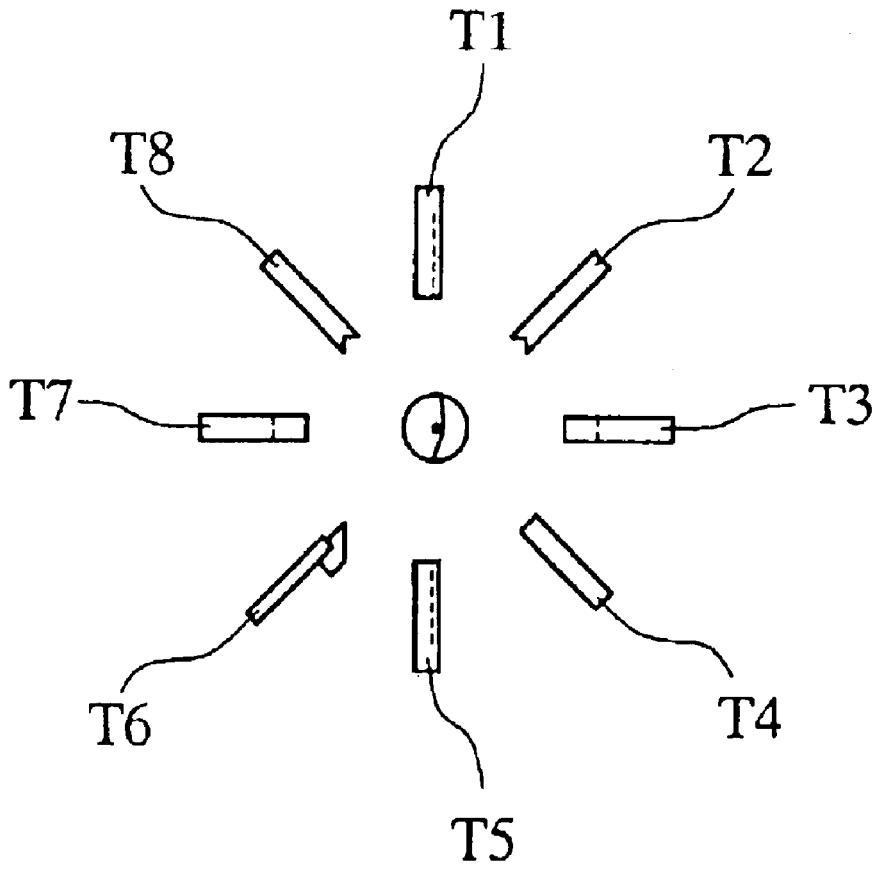
FIG. 13 is a layout view of forming tools before starting to form the wire spring shown in FIG. 12.

In this case, in a layout view of the forming tools shown in FIG. 13, reference symbols T1 and T5 denote coil forming tools, reference symbols T2 and T8 denote supporting tools, reference symbols T3 and T7 denote bending tools, reference symbol T4 denotes a cutting tool, and reference symbol T6 denotes an initial tension adjusting tool, respectively. However, these forming tools are based on the conventional art.

At first, the torque of the servo motor corresponding to the drive source 16 for the wire pressure feeding means is transmitted via the gear train in order of the pinion 15, the intermediate gear 14, the pressure feed roller driving gear 13, the bevel gear 10, the bevel gear 8, the pinion 8*a*, the intermediate gear 7, the intermediate pinion 6 and the gears 2*a* for driving the pressure feed rollers, the wire W gripped by the pressure feed rollers 1 rotating (rotating on their own axis) is pressure fed at a length of a portion a, and both of the supporting tool T2 and the bending tool T7 move forward in accordance with a step A so as to be brought into contact with the wire W, whereby a bent portion b is formed, and then both of the tools T2 and T7 move backward.

Next, the wire W is pressure fed at a length of a portion c in accordance with a step B, the torque of the servo motor corresponding to the drive source 32 of the revolving means is transmitted via the gear train in order of the pinion 31, the intermediate gear 30 and the revolution driving gear 29 in the mean while, and the wire W gripped between the pressure feed rollers 1 mounted to the main portion main frame 28 is twisted at 30 degrees (+30 degrees) in a counterclockwise direction as seen from a front face by the rotating (revolving) main portion main frame 28.

Next, both of the tools T2 and T7 move forward in accordance with a step C so as to be brought into contact with the wire W, a bent portion d is formed, and then both of the tools T2 and T7 move backward.

Next, the wire W is pressure fed at a length of a portion e due to a driving operation of the servo motor corresponding to the drive source 16 for the wire pressure feeding means in accordance with a step D, and the wire W is twisted at 90 degrees (+90 degrees) in a counterclockwise direction due to the driving operation of the servo motor corresponding to the drive source 32 for the revolving means in the mean while.

Next, both of the tools T2 and T7 move forward in accordance with a step E so as to be brought into contact with the wire W, a bent portion f is formed, and then both of the tools T2 and T7 move backward.

Next, the wire W is pressure fed at a length of a portion g due to a driving operation of the servo motor corresponding to the drive source 16 for the wire pressure feeding means in accordance with a step F, and the wire W is twisted at 90 degrees (−90 degrees) in a clockwise direction due to the driving operation of the servo motor corresponding to the drive source 32 for the revolving means in the mean while.

Next, the coil forming tool T1 moves forward in accordance with a step G so as to be brought into contact with the wire W, and the wire W is simultaneously pressure fed due to the driving operation of the servo motor corresponding to the drive source 16 for the wire pressure feeding means so as to start forming a coil portion h.

Next, the initial tension adjusting tool T6 moves forward just before first turn of the coil portion h is formed, in accordance with a step H, so as to be brought into contact with the coil portion h and start adjusting a pitch of the coil portion h.

Next, while the pressure feeding operation of the wire W is continued due to the driving operation of the servo motor corresponding to the drive source 16 for the wire pressure feeding means and the coil portion h is formed, the initial tension adjusting tool T6 moves backward about ¾ turn before the finish of forming of the coil portion h, then the driving operation of the servo motor corresponding to the drive source 16 for the wire pressure feeding means is stopped at a time when the forming operation of the coil portion h is finished, the pressure feeding operation of the wire W is stopped, and the coil forming tool T1 moves backward.

Next, the wire W is pressure fed at a length of a portion j due to the driving operation of the servo motor corresponding to the drive source 16 for the wire pressure feeding means in accordance with a step J, and the wire W is twisted at 90 degrees (−90 degrees) in a clockwise direction due to the driving operation of the servo motor corresponding to the drive source 32 for the revolving means in the mean while.

Next, both of the supporting tool T2 and the bending tool T7 move forward in accordance with a step K so as to be brought into contact with the wire W, a bent portion j is formed, and then both of the tools T2 and T7 move backward.

Next, the wire W is pressure fed at a length of a portion k due to the driving operation of the servo motor corresponding to the drive source 16 for the wire pressure feeding means in accordance with a step L, and the wire W is twisted at 90 degrees (+90 degrees) in a counterclockwise direction due to the driving operation of the servo motor corresponding to the drive source 32 for the revolving means in the mean while.

Next, the coil forming tool T5 moves forward in accordance with a step M, and is brought into contact with the wire W continuously pressure fed due to the driving operation of the servo motor corresponding to the drive source 16 for the wire pressure feeding means, the driving operation of the servo motor corresponding to the drive source 16 for the wire pressure feeding means is stopped at a time when the forming operation of the coil portion 1 is finished, the pressure feeding operation of the wire W is stopped, and the coil forming tool T5 moves backward.

Next, the wire W is pressure fed at a length of a portion m due to the driving operation of the servo motor corresponding to the drive source 16 for the wire pressure feeding means in accordance with a step N, both of the bending tool T3 and the supporting tool T8 simultaneously move forward so as to be brought into contact with the wire W, whereby a bent portion n is formed, and then both of the tools T3 and T8 move backward.

Next, when the wire W is pressure fed at a length of a portion o due to a driving operation of the servo motor corresponding to the drive source 16 for the wire pressure feeding means in accordance with a step O, the cutting tool T4 moves forward, and the wire W is cut at a front end of the quill Q.

Thereafter, the wire W is twisted at 30 degrees (−30 degrees) in a clockwise direction due to the driving operation of the servo motor corresponding to the drive source 32 for the revolving means and is returned to an origin at a time of starting the forming operation.

While the wire spring is formed from the wire W in accordance with the steps mentioned above, in each of the steps, the pressure feeding operation and the twisting operation are simultaneously applied to the wire W in most cases. Since a stroke of the forming tool may be set to a position at which the forming tool is not in contact with the wire W under the forming steps, a maximum stroke is not required in most cases.

Further, the wire W is twisted rightward and leftward while being intermittently pressure fed at a predetermined length, however, a maximum twisting angle during the steps is within 180 degrees, and the forming operation is executed on the basis of the layout returning to the origin at every time when the forming operation of one product is completed. Further, twisting in the forming steps is absorbed between the orientation looper 26 and a bundle of the wire W placed on a wire decoiler (not shown).

EFFECT OF THE INVENTION

As mentioned above in detail, the wire spring forming apparatus in accordance with the present invention achieves the following various kinds of effects, and has a very great industrial value.

① Since the structure is made such that the wire passes through the substantially center of the main portion main frame of the revolving means and the pressure feeding means of the wire, it is possible to arrange each of the members around the wire corresponding to the axis of revolution with keeping balance, and it is possible to achieve a simple, compact and light structure, and since the moment of inertia accompanying with the revolution is significantly small, it is possible to adjust and set the revolving speed and acceleration at a time of revolution high. That is, since the moment of inertia of the revolving means can be set to be not more than ⅓ in comparison with the same specification in the conventional art, and the consumed energy required for the revolution becomes about 60% so as to give a great economical efficiency, it is possible to provide a wire spring forming apparatus having a sufficient reserve capacity complying with a higher speed spring formation and having a high productivity.

② Since the pressurizing operation is performed from the immediately above portion of the pressure feed rollers, the deflection load becomes negligibly small, so that it is possible to form the wire spring at a high accuracy, and it is possible to make a contribution to restrict an increase of the moment of inertia of the revolving means.

③ Since not only it is possible to simultaneously change the pressure feeding and twisting directions of the wire at a high speed, but also the forming tools (the track rails and the slide units) may be constituted by the fixed type, it is possible to twist the wire in the directions in which the required forming tools are positioned while making good use of various kinds of attachments which are variously contrived, so as to form the wire spring in an unforced manner, so that it is possible to obtain a very high productivity in comparison with the turning method of the forming tools in accordance with the conventional art.

④ It is possible to install the drive source of the pressure feeding means to the main portion main frame of the revolving means so as to make the axis of the output shaft corresponding to the center of gravity of the drive source coincide with the axis of revolution of the main portion main frame in the revolving means, there is no eccentric load in the drive source itself of the pressure feeding means in this case, the increase of the moment of inertia caused by the accompanying revolution of the drive source for the pressure feeding means is a little, and it is possible to keep the moment of inertia of the apparatus in accordance with the present invention significantly low in comparison with the apparatus in which the drive source for the pressure feeding means is arranged out of the revolution in accordance with the conventional art.

⑤ It is possible to comply with both of the case in which the drive source for the pressure feeding means is arranged out of the revolving means and the case in which the drive source for the pressure feeding means is arranged within the revolving means, only by replacing a small number of relevant members. That is, it is possible to quickly respond to a user who desires a wire spring forming apparatus having a comparatively easy set-up operation because a movement of the wire is not generated at a time of revolving the revolving means, and a user who desires a wire spring forming apparatus having a high speed even if a lot of man hour is required because the movement of the wire is generated at a time of revolving the revolving means.

On the basis of the structure in which the intermediate linear guide which integrally rotates with the linear guide provided in the front face side of the pressure feed rollers and has the front face side end portion conforming to the axis of the quill is provided in the front face side of the linear guide, the wire fed out from the portion on the axis of the linear guide can be fed out in the state of being conformed to the axis of the quill after being moved along the axis of the intermediate linear guide even when the center blurring in the axis of the linear guide provided in the front face side of the pressure feed roller and the center blurring in the axis of the quill exist, in the case of having a function o executing the rotational positioning control of the quill around the axis thereof. Accordingly, it is possible to secure the accuracy of the product.

What is claimed is:

1. A wire spring forming apparatus, comprising:

a quill configured to guide a wire;

a plurality of forming tools radially arranged around an axis of the quill and are movable forward and backward perpendicular to or substantially perpendicular to an axis of the quill;

a plurality of pressure feed rollers, consisting of a plurality of first pressure feed rollers and a plurality of second pressure feed rollers, configured to hold and pressure the wire based on a rotation of the feed rollers, and the pressure feed rollers are configured to revolve around an axis of the wire while holding the wire to be pressure fed between the pressure feed rollers, wherein the first pressure feed rollers and a power transmitting means for transmitting a drive force to the first pressure feed rollers are mounted to a main portion main frame of a revolving means supported to a main body frame rotatably or are mounted to position adjusting arms swingably supported to the main portion main frame;

the second pressure feed rollers are mounted to supporting arms on two sides swingably attached to a fulcrum shaft that is rotatably supported to the main portion main frame perpendicular to the wire pressure feeding direction, so that gears for driving the pressure feed rollers arranged neighbouring the respective pressure feed rollers are engaged with each other;

each pressure feed roller is positioned at a middle or a substantially middle of a spindle having both ends supported or pivoted to the main portion main frame or the position adjusting arms and the supporting arms, respectively; and a point of application of pressure on each supporting arm is positioned immediately or substantially immediately above the second pressure feed rollers.

2. The wire spring forming apparatus as claimed in claim 1, wherein the pressure feed rollers and the gears for driving the pressure feed rollers arranged neighbouring the respective pressure feed rollers, are provided on sleeves rotatably attached onto outer peripheral surfaces of the spindles having the ends which are respectively swingable supported to the main portion main frame or the position adjusting arms and the supporting arms via inner rings and bearings.

3. The wire spring forming apparatus as claimed in claim 1, wherein the pressure feed rollers and the gears for driving the pressure feed rollers arranged neighbouring the respective pressure feed rollers, are provided on sleeves rotatably attached onto outer peripheral surfaces of the spindles having the ends which are respectively swingable supported to the main portion main frame or the position adjusting arms and the supporting arms via bearings.

4. The wire spring forming apparatus as claimed in claim 1, wherein the pressure feed rollers and the gears for driving the pressure feed rollers arranged neighbouring the respective pressure feed rollers, are provided on sleeves rotatably attached onto outer peripheral surfaces of the spindles having the ends which are respectively swingable pivoted to the main portion main frame or the position adjusting arms and the supporting arms via metal bearings.

5. The wire spring forming apparatus as claimed in claim 1, wherein the main portion main frame and the supporting arms each comprise a U-shaped integrally constructed member supporting or pivoting the ends of the spindle on which the pressure feed roller and the gear for driving the pressure feed roller are arranged.

6. The wire spring forming apparatus as claimed in claim 1, wherein a drive source for the power transmitting means for transmitting the drive force to the pressure feed rollers is fixed to the main portion main frame.

7. The wire spring forming apparatus as claimed in claim 6, wherein the drive source of the power transmitting means for transmitting the drive force to the pressure feed rollers is fixed to an opposite surface of the main portion main frame with gripping a boss portion integrally formed with the main portion main frame of the revolving means, so that a through hole for inserting the wire is provided on an axis of an output shaft thereof, and the axis of the output shaft coincides with an extension of an axis of the revolving means.

8. The wire spring forming apparatus of claim 6, wherein an intermediate linear guide, which integrally rotates with a linear guide provided in a front face side of the pressure feed rollers and has a front face side end portion conforming to the axis of the quill, is provided in a front face side of the linear guide.

9. The wire spring forming apparatus as claimed in claim 1, wherein an intermediate linear guide, which integrally rotates with a linear guide provided in a front face side of the pressure feed rollers and has a front face side end portion conforming to the axis of the quill, is provided in a front face side of the linear guide.

* * * * *